US008292630B1

(12) United States Patent
Bobuk

(10) Patent No.: US 8,292,630 B1
(45) Date of Patent: Oct. 23, 2012

(54) BOARD MOUNTED CONNECTOR WITH PROTECTIVE SHELL

(75) Inventor: Aaron Michael Bobuk, Bellevue, WA (US)

(73) Assignee: Hon Hai Precision Inc. Co., Ltd., New Taipei (TW)

( * ) Notice: Subject to any disclaimer, the term of this patent is extended or adjusted under 35 U.S.C. 154(b) by 0 days.

(21) Appl. No.: 13/168,925

(22) Filed: Jun. 24, 2011

(51) Int. Cl.
*H01R 12/00* (2006.01)

(52) U.S. Cl. ..... 439/65; 439/74; 439/136; 439/367

(58) Field of Classification Search ..... 439/65, 439/66, 74, 135, 136, 367
See application file for complete search history.

(56) References Cited

U.S. PATENT DOCUMENTS

| | | | | |
|---|---|---|---|---|
| 7,322,830 | B2 * | 1/2008 | Szu | 439/66 |
| 7,404,717 | B2 * | 7/2008 | Kazama | 439/66 |
| 7,585,185 | B2 | 9/2009 | Obikane | |
| 7,637,750 | B1 * | 12/2009 | Polnyi | 439/66 |
| 7,922,498 | B2 * | 4/2011 | Lin | 439/71 |

* cited by examiner

*Primary Examiner* — James Harvey
(74) *Attorney, Agent, or Firm* — Wei Te Chung; Ming Chieh Chang

(57) ABSTRACT

A board mounted connector (100) includes an insulative housing (1) defines a top side and a bottom side; a plurality of terminals (2) combined with the insulative housing, each terminal having a contacting portion disposed above the top side of the insulative housing; and a protective cover (3) floatably associated with the insulative housing and enclosing the contacting portions of the terminals.

13 Claims, 9 Drawing Sheets

BOARD MOUNTED CONNECTOR WITH PROTECTIVE SHELL

FIELD OF THE INVENTION

The present invention relates to a board mounted connector, especially to a low profile board connector for connecting two circuit boards.

DESCRIPTION OF RELATED ART

Board mounted connectors or board-to-board connectors are widely used inside an electronic device for electrically connecting two circuit boards. A common board mounted connector usually includes two individual connectors respectively mounted to a corresponding circuit board. For example, U.S. Pat. No. 7,585,185 issued on Sep. 8, 2009 to Obikane discloses a board mounted connector which has a plug connector adapted for mating with a receptacle connector. The plug connector is mounted to one circuit board, and the receptacle connector is mounted to another circuit board.

In order to decrease the size of the electronics devices, board mounted connectors are getting smaller and smaller. The smaller the connector is made, the contacts become more fragile and susceptible to damage. Particularly during transportation and installation of these small connectors, foreign objects (such as fingers) are likely to come in contact with the connectors which may cause damage. Contacts on a larger connector are typically durable enough to survive contact with such foreign body, but the smaller connectors need some sort of protection.

Hence, an improved board mounted connector is required to overcome the problems of the prior art.

SUMMARY OF THE INVENTION

An object of the present invention is to provide a lower profile board mounted connector with protective means.

Accordingly, to achieve above-mentioned object, the board-to-board connector comprises an insulative housing; a plurality of terminals combined with the insulative housing, each terminal having a contacting portion disposed above the top side of the insulative housing; and a protective cover or shield floating above the insulative housing and enclosing the contacting portions of the terminals.

The detailed features of the present invention will be apparent in the detailed description with appropriate reference to the accompanying drawings.

DETAILED DESCRIPTION OF THE INVENTION

Reference will now be made in detail to the preferred embodiment of the present invention.

Figure 1:
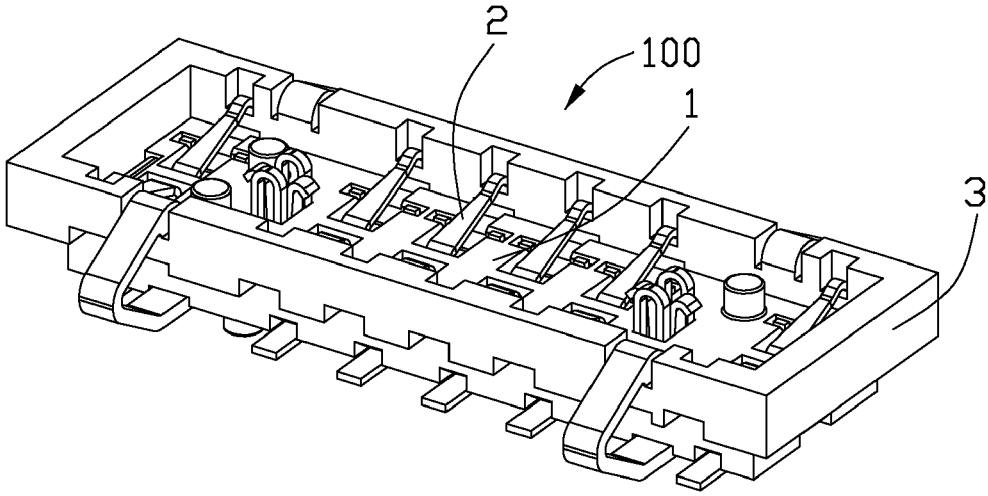
FIG. 1 is an assembled, perspective view of board mounted connector in accordance with the present invention.
Figure 2:
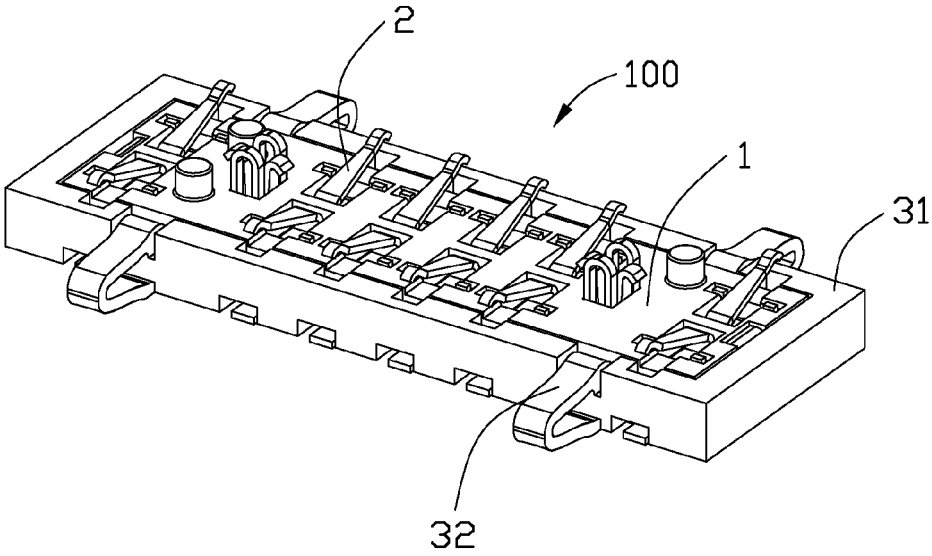
FIG. 2 illustrates a protective cover over the board-to-board connector deflected downward so as to expose the contacts.
Figure 3:
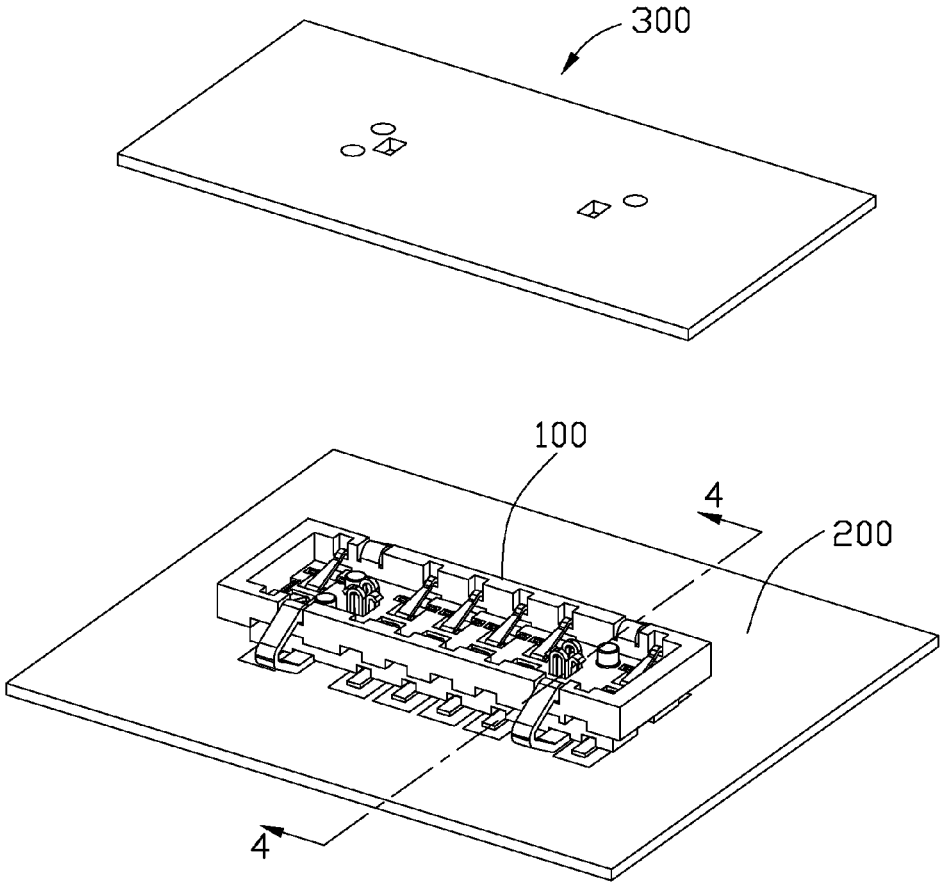
FIG. 3 shows the board mounted connector located on one circuit board and not mated with the other circuit board.
Figure 4:
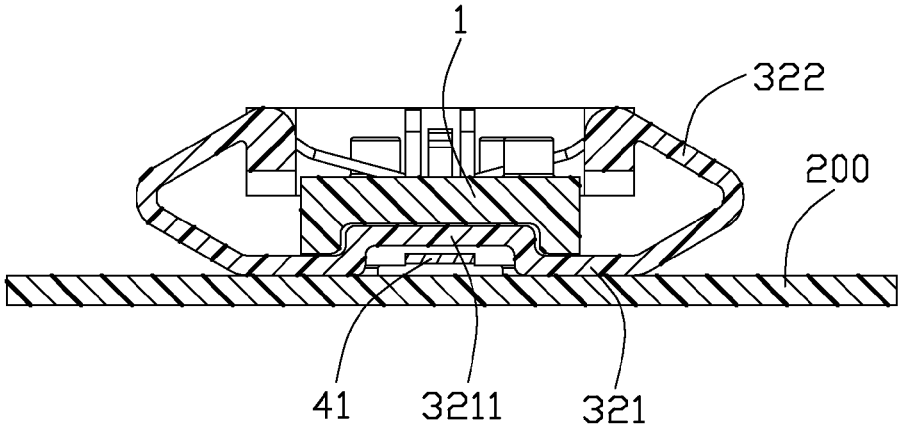
FIG. 4 is a cross-sectional view of FIG. 3 taken along line 4-4.
Figure 5:
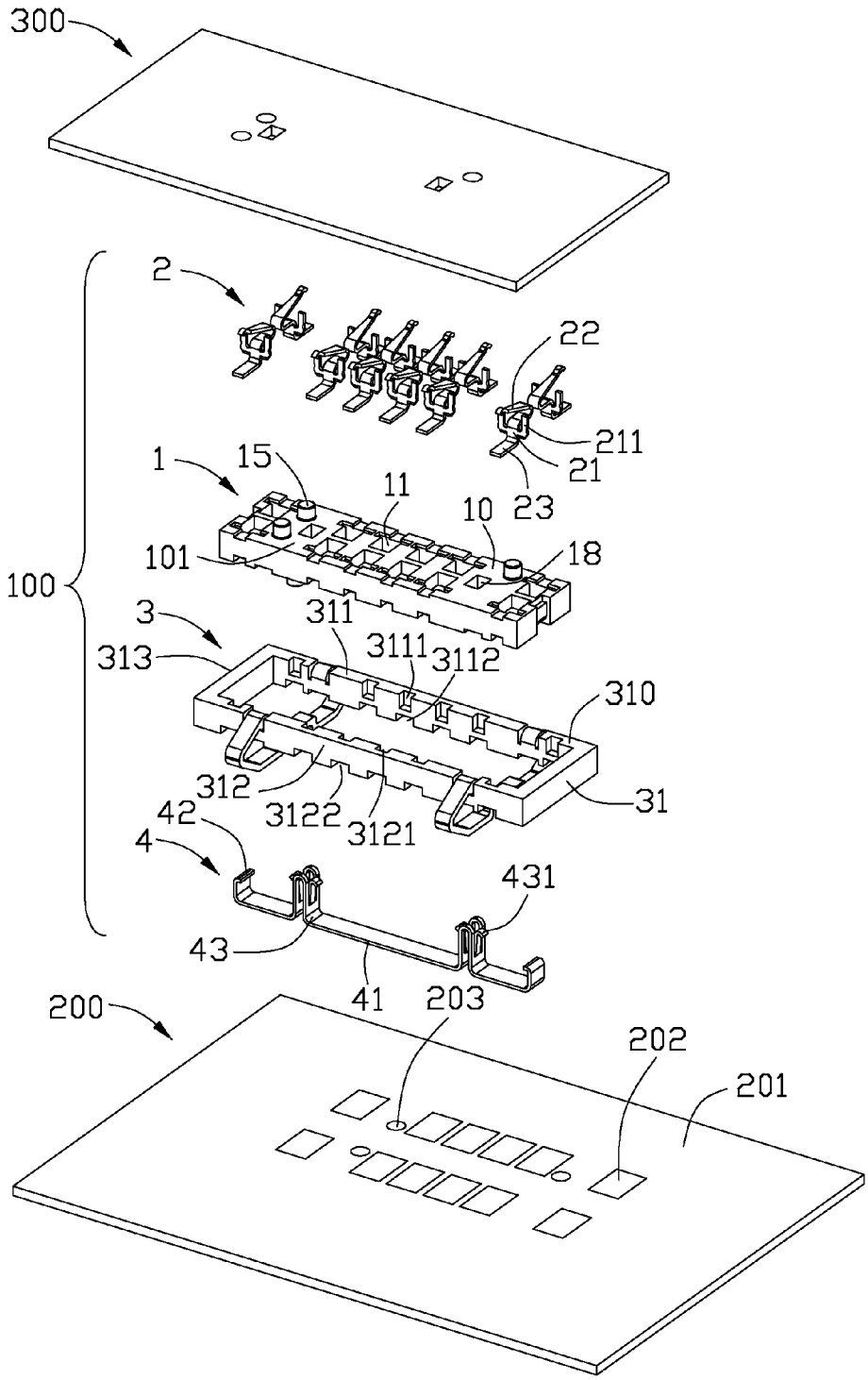
FIG. 5 is an exploded, perspective view of the board mounted connector.
Figure 6:
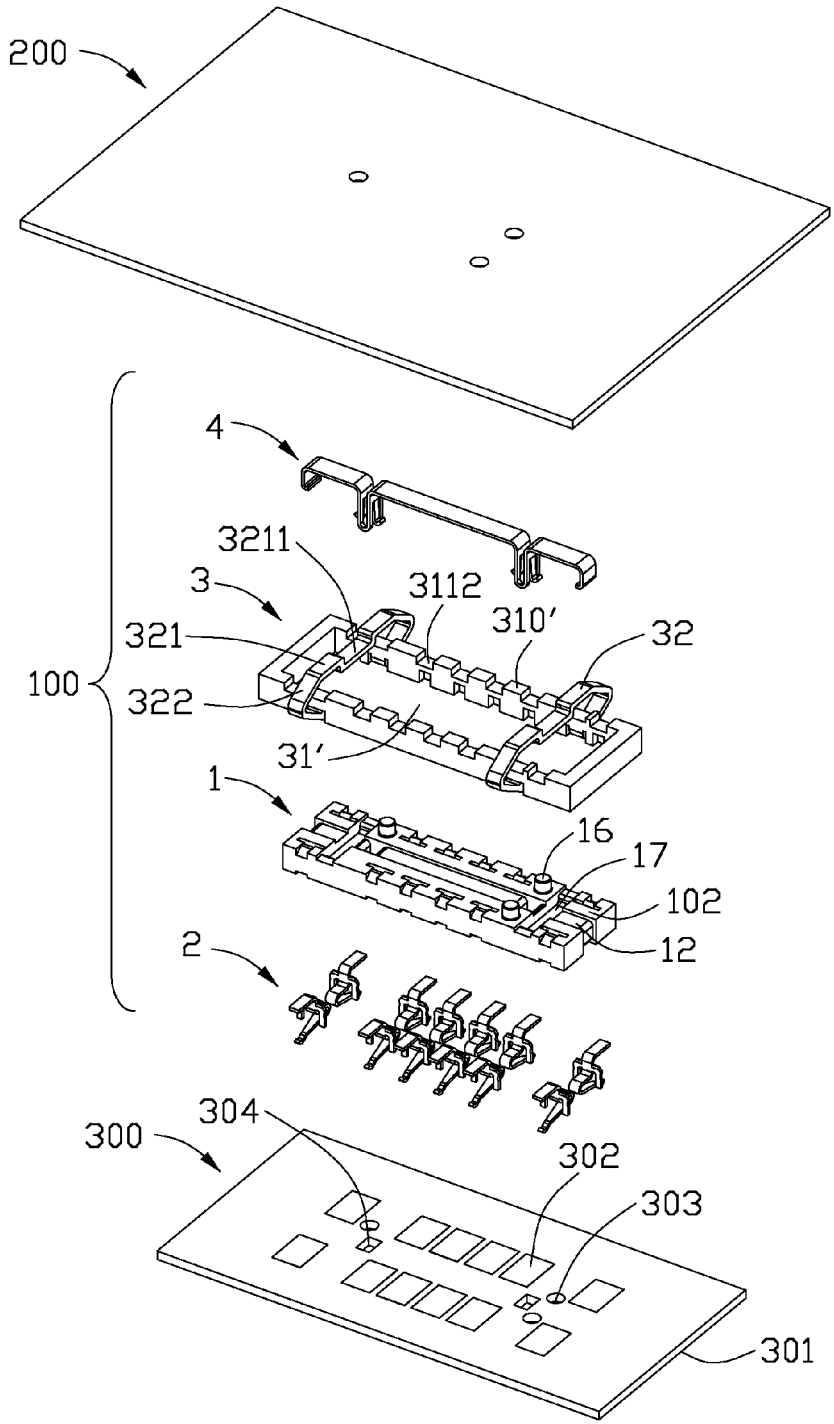
FIG. 6 is a view similar to FIG. 5, but viewed from other direction.
Figure 7:
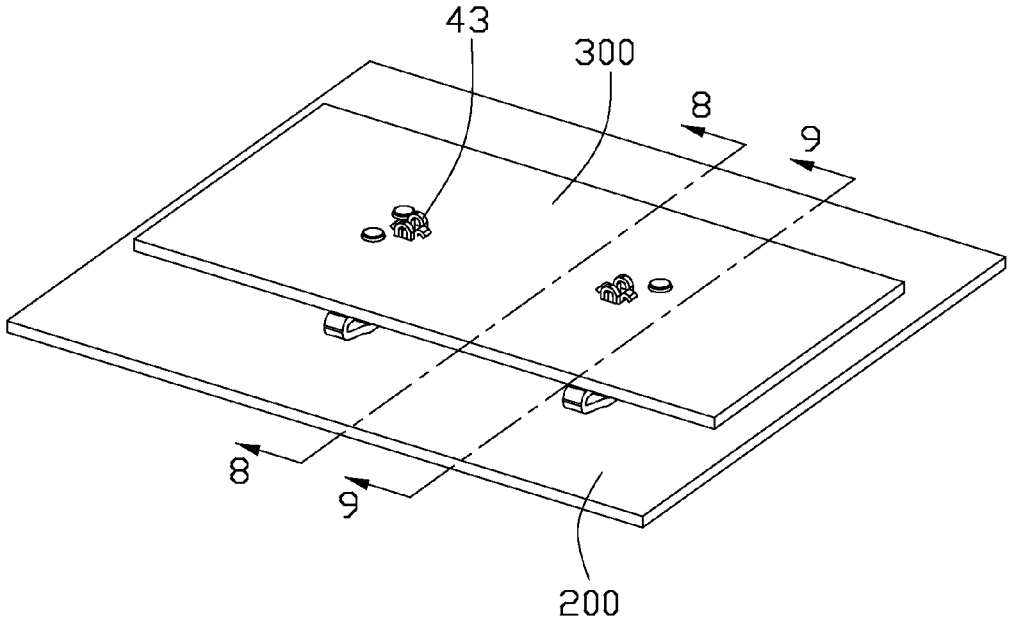
FIG. 7 illustrates the two circuit boards electrically connected with each other via the board mounted connector.
Figure 8:
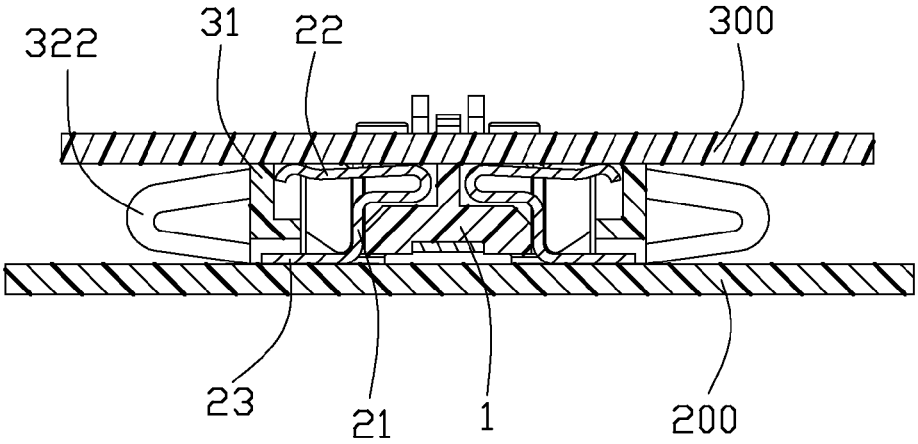
FIG. 8 is a cross-sectional view of FIG. 7 taken along line 8-8.
Figure 9:
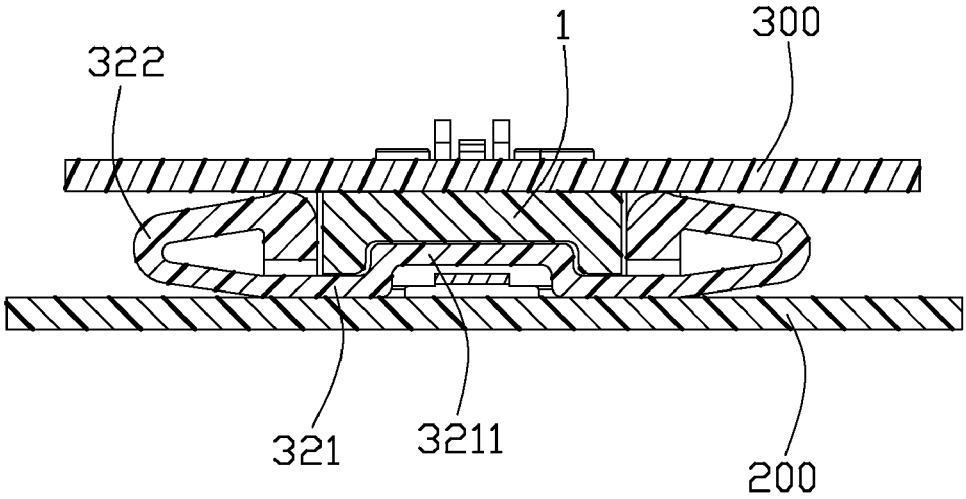
FIG. 9 is a cross-sectional view of FIG. 7 taken along line 9-9.

Referring to FIGS. 1-9, a board mounted connector or board-to-board connector 100 is adapted for connecting with a first circuit board (mounting board) 200 and a second circuit board (mating board) 300.

The board mounted connector 100 comprises an insulative housing 1, a plurality of terminals 2 combined with the insulative housing 1, a protective cover 3, floatably associated with the insulative housing 1 to prevent the terminals from being damaged and a retaining clip 4 for securing the protective cover 3, insulative housing 1, and the mating circuit board 300.

The insulative housing 1 has a lengthwise main portion 10 extending along a transversal direction. The main portion 10 has a top side 101 and a bottom side 102. A plurality of terminal slots 11 are defined in the main portion 10 and divided into a front terminal set and a back terminal set respectively along the transversal direction. The terminal slots 11 of the front terminal set align with the terminal slots 11 of the back terminal set, respectively. There is a lengthwise positioning slot 12 located in middle of the bottom side 102 and lateral sections of the main portion 10. There are three first guiding posts 16 projecting downwardly from the bottom side 102. There are two through holes 18 located in the middle of opposite sections of the main portion 10. In addition, there are three guiding posts 15 projecting upwardly from the top side 101. There are two cavities 17 respectively located in the bottom side 102 of lateral sections of the main portion 10. The two cavities 17 are deeper than the positioning slot 12 and further perpendicular to the positioning slot 12.

Each terminal 2 includes a retention portion 21 located in an imagery vertical plane, a contacting portion 22 obliquely extending upward from the retention portion 21 and a tail portion 23 horizontally extending outward from the retention portion 21. The retention portion 21 has two branches 211 arranged at opposite sides thereof and projecting upwardly. The contacting portion 22 is deformable along the vertical direction. The terminals 2 are engaged with the insulative housing 1, with the branches 211 of the retention portions 21 inserted into the insulative housing 1, the contacting portions 22 upwardly extending through the terminal slots 11 and disposed above the top side 101 of the insulative housing 1, and the tail portions 23 disposed under the insulative housing 1 and further extending beyond a front and back surface of the insulative housing 1.

The protective cover 3 has a frame 31 and two elastic arms 32 for supporting the frame 31. The elastic arm 32 spans cross the frame 31 along the front to back direction. The frame 31 has an upper side 310 and a lower side 310'. The frame 31 has a front wall 311, a rear wall 312 and a pair of lateral walls 313 connecting with ends of the front wall 311 and the rear wall 312 to form a receiving space 31' there among. The front wall 311 defines a number of grooves 3111 located in an upper section of an inner side of the front wall 311 and a number of passages 3112 defined in a lower section of the front wall 311. The groove 3111 and the passages 3112 both communicate with the receiving space 31' of the frame 31. The rear wall 312 also has a number of grooves 3121 and passages 3122. The elastic arm 32 is a bowed shaped member and has a horizontal segment 321 extending along the front-to-back direction and two V-shaped elastic segments 322 respectively connected with front and back ends of the horizontal segment 321. The horizontal segment 321 of each elastic arm 32 is located under the frame 31. In addition, a middle part of the horizontal segment 321 is raised upward to form a positioning part 3211. The two V-shaped elastic segments 322 further connected with the front wall 311 and the rear wall 312.

The retaining clip 4 is made of a metallic material and includes a horizontal bar 41 extending along the transversal direction and two hooks 42 formed at opposite sides of the horizontal bar 41 and projecting upwardly. The retaining clip 4 further has two inverted U-shaped engaging portions 43 formed by bending a length of horizontal bar 41. The two engaging portions 43 are spaced from each other along the transversal direction and respectively located adjacent to the corresponding hooks 42. In addition, there are two latching parts 431 formed with the engaging portion 43 and oppositely deflected along the transversal direction.

The protective cover 3 is assembled to the insulative housing 1, with the front wall 311, the rear wall 312 and the lateral walls 313 enclosing or surrounding the main portion 10, the positioning parts 3211 of the elastic arm 32 is accommodated in the two cavities 17 of the insulative housing 1. The retaining clip 4 is assembled to the insulative housing 1 to fix the protective cover 3 thereto, with the horizontal bar 41 received in the lengthwise positioning slot 12 and further positioning the positioning parts 3211, the hooks 42 gripping the insulative housing 1. The two engaging portions 43 pass through two through holes 18 and extend beyond the top side 101. The top side 101 of the insulative housing 1 is disposed lower than the upper side 310, and the contacting portions 22 of the terminals 2 accommodated in the receiving space 31', free ends of the contacting portions 22 are hidden inside the grooves 3111 of the front wall 311 and the rear wall 312. Thus, the contacting portions 22 are enclosed by the protective cover and protected from being damaged. The frame 31 is supported by the elastic arm 32 and floatable with regarding to the insulative housing 1, and that is to say, the frame 3 can be pushed downwardly to let the insulative housing 1 enter the receiving space 31' thereof until the upper side 310 flush with the top side 101 of the insulative housing 1, so as to have the contacting portions 22 of the contacts 2 exposed beyond the upper side 310 of the frame 31; and the tail portions 23 of the terminals 2 enter the passages 3122 at the same time.

The first circuit board 200 has a substrate 201, a plurality of conductive traces 202 formed on the substrate 201 and three first holes 203 defined in the substrate 201. The second circuit board 300 has a board 301, a plurality of conductive pads 302 formed on the board 301 and three second holes 303 defined in the board 301. In addition, there are two locking holes 304 defined in the board 301. The board mounted connector 100 is supported by the first circuit board 200, with the first guiding posts 16 of the insulative housing 1 inserted into the first holes 203 of the substrate 201, and the tail portions 23 disposed on the conductive traces 202 and soldered thereto. The second circuit board 300 is placed on the protective cover 300 and pressed downwardly to deflect the elastic arms 32 on the protective cover 3 as it is moved toward the first circuit board 200, then the contacting portions 22 exposed beyond the upper side 310 of the protective cover 3 and make contact with the conductive pads 302 to achieve electrical connection between the first circuit board 200 and the second circuit board 300. The second guiding posts 15 are inserted into the second holes 303 in the second circuit board 300 to prevent backwards insertion. The engaging portions 43 are engaged with the locking holes 304, with latching parts 431 latching with the second circuit board 300.

Alternatively, as shown in this design, the board-to-board connector can be one piece with cantilever-beam style contacts that are spring loaded to make contact with a solder pad on the mating circuit board. It should be noted that this method for protecting contacts is not limited only to cantilever-beam style contacts.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A board mounted connector, comprising:

an insulative housing defines a top side and a bottom side;

a plurality of terminals combined with the insulative housing, each terminal having a contacting portion disposed above the top side of the insulative housing;

a protective cover floatably associated with the insulative housing and enclosing the contacting portions of the terminals;

the two elastic arms are spaced apart from each other along a transversal direction and further fixed with the insulative housing;

the frame has a front wall, a rear wall and a pair of lateral walls connecting with ends of the front wall and the rear wall to form the receiving space; and each elastic arm has a bowed shaped and has a horizontal segment extending along the front-to-back direction and two V-shaped elastic segments respectively connected with front and back ends of the horizontal segment.

2. The board mounted connector as claimed in claim 1, wherein the protective member includes a frame and two elastic arms supporting the frame, and the protective member defines a receiving space to accommodate the contacting portions.

3. A board mounted connector arranged between a first circuit board and a second circuit board for establishing an electrical connection therebetween, comprising:

an insulative housing supported by the first circuit board;

at least one terminal combined with the insulative housing, the terminal having a contacting portion and a tail portion electrically connected to the first circuit board;

a protective cover having a frame with a receiving space to accommodate the contacting portion of the terminal;

wherein the protective cover is moved toward the first circuit board to expose the contacting portion when the second circuit board is assembled; there is a retaining clip assembled to the insulative housing to fix the protective cover thereto;

the protective cover further has two elastic arms supporting the frame;

each elastic arm has a horizontal segment and two elastic segments connected with opposite ends of the horizontal segment, and the horizontal segment is received in a corresponding cavity located in a bottom side of the insulative housing.

4. The board mounted connector as claimed in claim 3, wherein the retaining clip has a horizontal bar extending along the transversal direction and located in the positioning slot defined in the bottom side of the insulative housing and perpendicular to the cavity.

5. The board mounted connector as claimed in claim 4, wherein the retaining clip further has at least one engaging portion formed with horizontal bar, passing through a corresponding through hole in the insulative housing and engaged with a corresponding locking hole in the second circuit board.

6. The board mounted connector as claimed in claim 1, wherein the horizontal segment is located under the frame and the elastic segment respectively connected with the front wall and the rear wall.

7. The board mounted connector as claimed in claim 1, wherein there is a corresponding cavity respectively located in a bottom side of the insulative housing to receive the horizontal segment of the elastic arm.

8. The board mounted connector as claimed in claim 7, wherein a middle part of the horizontal segment is raised upward to form a positioning part accommodated in the cavity.

9. The board mounted connector as claimed in claim 7, wherein there is a retaining clip assembled to the insulative housing and to a mating circuit board which provides positioning of the parts.

10. A board mount connector comprising:

an insulative housing;

a plurality of contacts disposed in the housing, each of said contacts defining an upward contacting section;

a protective cover assembled to the housing and defining a frame surrounding the housing in a floating manner; wherein the protective cover is urged by spring devices toward an upper position where the contacting sections are below the frame; the housing is equipped with latching devices, which is surrounded in the frame, for locking to a printed circuit board which is adapted to be seated upon the cover.

11. The board mounted connector as claimed in claim 3, wherein the second circuit board is placed on the protective cover and pressed downwardly to urge the protective cover moving toward the first circuit board.

12. The board mounted connector as claimed in claim 3, wherein the second circuit board has a board, a corresponding conductive pad formed on the board, and the contacting portion of the terminal makes contact with the conductive pad.

13. The board mount connector as claimed in claim 10, wherein said latching devices are formed on a retaining clip which fastens the housing and the cover together.

* * * * *